United States Patent [19]

Duncan

[11] Patent Number: 4,799,371

[45] Date of Patent: Jan. 24, 1989

[54] KEYLESS LOCK

[75] Inventor: Robert Duncan, Cambuslang, Scotland

[73] Assignee: Aardee Spring & Lock Co., Ltd., Glasgow, Scotland

[21] Appl. No.: 47,874

[22] Filed: May 7, 1987

[51] Int. Cl.[4] ..... E05B 37/16

[52] U.S. Cl. ..... 70/214; 70/298; 70/284

[58] Field of Search ..... 70/214, 313, 297, 298, 70/299, 284, 285

[56] References Cited

U.S. PATENT DOCUMENTS

| | | | |
|---|---|---|---|
| 1,530,861 | 3/1925 | Standen | 70/214 |
| 2,000,111 | 5/1935 | Weis | 70/214 |
| 3,099,150 | 7/1963 | Check | 70/214 |
| 3,435,647 | 4/1969 | Le Blanc | 70/214 |

*Primary Examiner*—Robert L. Wolfe
*Attorney, Agent, or Firm*—Stephen G. Rudisill

[57] ABSTRACT

A keyless button lock is described in which a plurality of lock buttons are provided, each button requiring a particular number of presses to attain an open or lock release position. A lock element is also provided which, when actuated, returns all buttons to a locked position. The buttons have more than one release or open position so that master and grand master keying can be provided. The lock may be coupled to a door lock mechanism in a single unit to minimize space and complexity. Embodiments of the invention are described.

19 Claims, 3 Drawing Sheets

KEYLESS LOCK

The present invention relates to keyless locks, and particularly, but not exclusively, relates to keyless button locks.

A keyless button lock should satisfy a number of desirable criteria in addition to being relatively inexpensive and reliable. It should be capable of providing a substantial number of combinations for security and should be coupled with a lock opening mechanism to provide an integral and compact structure. It should also permit master keying so that the locks or similar types of the locks can be used in hotels, office buildings and the like, and it should also be capable of being mechanically or electro-mechanically coupled to a lock mechanism, for example for use as a strong room or a front door lock.

Existing keyless button locks have buttons which can only be pressed once and this limits the number of combinations or different combinations (generally called differs) which can be achieved by the number of the buttons on the lock. Furthermore, existing button locks are coupled to button mechanisms which are separate from the knobs, therefore two separate mechanism are required to be actuated in order to open the lock. Also prior art mechanisms are unsuitable for master keying or master coding and this limits their use in environments such as hotels and offices where a master code or master key is desired to obtain access to each room in the building. Furthermore, such locks are incapable of being electro-mechanically or mechanically coupled to lock mechanisms and are therefore inflexible with regard to their use in different environments.

An object of the present invention is to provide an improved keyless button lock which obviates and mitigates the disadvantages associated with the aforementioned structures.

This is achieved by providing a keyless button lock in which a plurality of lock buttons are provided, each button requiring a particular number of presses to attain open or lock release position. A lock element is also provided which, when actuated, returns all buttons to a locked position.

The buttons should have more than one release or open position so that master and grant master keying can be provided. The lock may be coupled to a door locking mechanism in a single unit to minimise space and complexity.

In one embodiment, each keyless button lock consists of a spring biased back-pin set in a door cylinder which extends beyond a locking plane defined by the front face of the door and into registering recesses of the handle to abut end of a toothed rack position, called a first split. The toothed rack has a plurality of teeth and can be advanced, one tooth at a time, towards the split plane by pushing the button. The button is resiliently biased and the advance and lock mechanism consists of a drive spring coupled to the button for advancing the rack. The rack is retained in its advanced position by a lock spring which is coupled to the face plate of the handle. When the rack is advanced so that the first split is aligned in the split plane the button is open and when each button is so positioned the handle can be turned and the lock opened.

The hold and push springs are shaped to lie on a cam surface of the release pin rack and depression of the lock button causes the cam surface to be moved so that the lock springs clamp down and each resiliently biased pin is forced into the corresponding registering recess in the handle to force the toothed rack back into a locking position. When the lock button is released the cam surface forces the lock and drive pins to original positions where the racks can be advanced once again by depression of the respective buttons.

The number of teeth in each rack can be varied and the length of each rack can be varied to define the number of presses required to register the first split with the split plane so that the button is in an open position. The locking mechanisms is also incorporated in the handle to provide a compact structure which is inexpensive and easily fitted to a door in a conventional manner.

Other splits are provided in each rack at predetermined positions so that each button can reach a release or open position after a different number of presses. For example, there can be a plurality of second splits arranged so that they align with the split plane after a different number of push combinations, however these push combinations would be the same for each of say a hundred locks to give a master code which can be used to open the locks for example in a hotel or suite of offices. Furthermore, a second split can be provided for grand master key coding in larger hotels and larger office suites, for example for use by a general or office manager.

The toothed racks are made of hardened steel and are rotatable in the respective recesses to minimise the risk of being sawn through.

In another embodiment of the invention, the keyless button lock consists of a generally flat circular case having a plurality of push buttons disposed around its periphery. The push buttons are spring biased and are coupled to racks of square or rectangular cross-section providing four faces which can be used for different purposes. Each rack has a plurality of teeth on at least one face and can be advanced one tooth at a time towards a neutral position, by a drive spring coupled to the push button at the periphery of the case. A hold spring, anchored to an adjoining push button by a button and rack spring, retains the rack in its advanced position.

Each rack has, on another face, a plurality of gates which determine the code for opening the lock. The lock has an opening element, called a thumbit which, when rotated, will open the lock assuming that all codes have been entered to advance each respective rack to its neutral position. When each rack is in its neutral position a keep, normally unrotatable, coupled to the thumbit, is rotated through the gates. A spindle is coupled to the keep/thumbit which when rotated causes actuation of the latch, or the like, to open the door. If it is desired to return the lock to a locked position this can be achieved by actuating a reset key by a lever at the side of the case to move the hold and drive springs out of engagement with each respective rack so that the button and rack springs urges each rack back to an initial position and the locking mechanism is again operative, assuming that the keep is not within the gate of the rack, otherwise closing may be prevented.

The number of gates in each rack and the length of each rack may be varied to define the number of presses needed to bring a gate into the neutral position. Also the push button has a recess for receiving a spindle mounted on the case. The recess is larger than the spindle so that when the button is pushed it moves a certain distance sufficient for the drive spring to advance the rack one tooth at a time.

The structure in this embodiment is compact and is suitable for use as an automobile lock as well as a door lock, safe lock and the like. It is also versatile in that different locks can have the same code and the structure can be used with existing locks. For example, the spindle may be coupled to a key for yale locks. Also, this structure permits any number of turns or part-turns in order to open the lock in contrast to the ¼ turn used in the first embodiment.

Master and grand master keying can be provided by a different code to advance the racks so that a neutral position is needed for all locks for the same code so that each lock can be opened. This is achieved by aligning the rack gates in response to entry of this different code to permit the keep to rotate and open the lock.

The parts of the mechanism can be made of hardened steel or composite metal, and either stamped or forged as before.

Accordingly, in one aspect of the present invention there is provided a keyless lock device comprising a housing having at least one lock release button disposed in a surface thereof and at least one lock element disposed on said surface, said lock release button being actuatable to define a plurality of lock positions and at least one lock release position, and said lock element being operatively coupled to said lock release button, the arrangement being such that, in use, actuation of said lock release button a predetermined number of times attains said lock release position whereby said keyless lock can be opened and actuation of said lock element actuates said lock release buttons to return a lock position from said lock release position.

Preferably a plurality of lock release buttons are provided, each of said lock release buttons defining a plurality of different positions. Conveniently said plurality of lock release buttons are disposed in a circle on the face plate of said housing around said lock button. Alternatively said housing is disc-shaped and said buttons are disposed around the periphery of said disc on the curved surface thereof.

Conveniently a locking mechanism is disposed in said housing and is coupled to said keyless button lock.

Preferably each lock release button has two or more lock release positions, one of which corresponds to a master code position. Conveniently three or more release positions are provided and the third lock release position corresponds to the position to define a grand master code position.

Conveniently said mechanism includes a door mounted cylinder portion having a plurality of holes disposed around the circumference. The door cylinder is coupled to the lock mechanism and to the handle so that actuation of the handle causes the lock mechanism to open.

The handle has a plurality of recesses each in register with a corresponding recess in a door cylinder and the door surface defines a split plane about which the handle can be turned to open, each recess having a pin disposed therein being resiliently biased to push the pin to extend said split plane partly into the registering recess on said handle, each button having an associated advance mechanism by which depressing the corresponding release button forces said pin back to said split plane when said button is depressed a predetermined number of times to define said release position.

Preferably also, each keyless button mechanism and said release button is coupled to a toothed rack, the rack being proportioned so that when said button is pushed a predetermined number of times the first split is on one of the split plane, so that when each split plane of all the buttons coincide said handle can be turned to open the lock.

Coveniently all key lock buttons are coupled to a single lock button which is resiliently biased and depression of said single lock button releases all buttons from release position to return to said lock position.

Preferably also, said advance mechanism includes a drive spring coupled between its respective button and the toothed rack, and the lock spring coupled to the face plate and engaged with a tooth of said toothed rack, said springs being supported on a cam surface of said lock pin in the locking position. Conveniently each button is coupled to a return spring disposed in a recess and after depression of each button the advancement of said toothed rack said return spring returns said button to its original position.

Conveniently a cover plate is disposed on the door between the handle and the cylinder. Any suitable number of teeth can be used with each toothed rack, however it will be appreciated that the more teeth used and the more depressions of the buttons required to reach a release position provided more combinations available by the lock and therefore greater security.

These and other aspects of the invention will become apparent from the following description when taken in combination with the accompanying drawings in which:-

Figure 1:
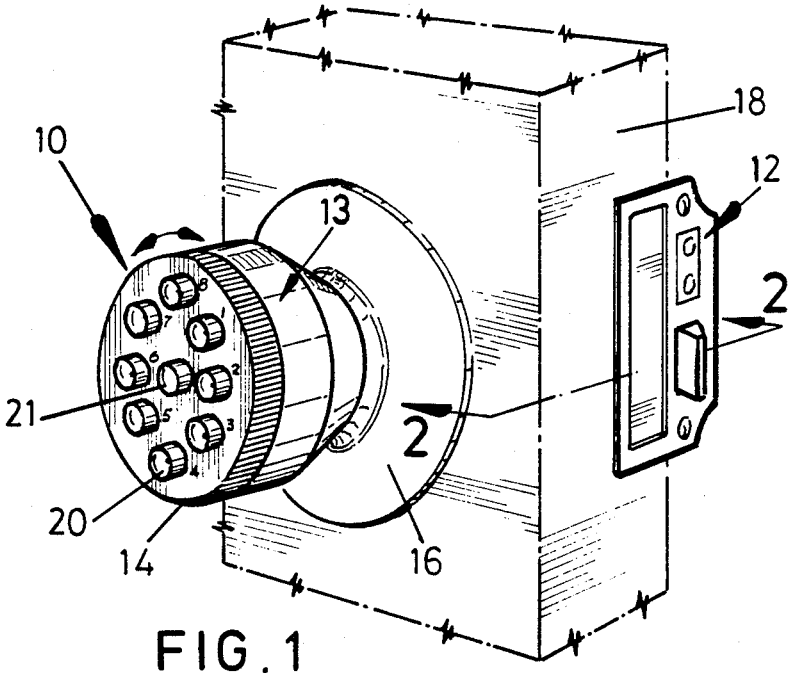
FIG. 1 is a perspective view of a keyless door handle when mounted on part of a door with a keyless button lock in accordance with an embodiment of the invention.

Reference is now made to FIG. 1 of the drawings which illustrates a perspective view of a keyless lock door handle generally indicated by reference numberal 10 coupled to a door lock mechanism indicated by reference numeral 12. The door handle is of the same size and general shape as conventional door handles and has a housing 12 on which is secured a face plate 14. A cover plate 16 is mounted between the handle and the door 18.

As can be seen a plurality of push buttons are disposed on the face plate for actuation of the locking mechanism as will be described.

In the example shown eight lock release buttons are disposed in a circle about a central lock button. As will be described, all buttons are resiliently biased so that after each actuation or depression of the button it returns to its original position substantially shown in the drawing. When the buttons are depressed a predetermined number of times and a particular button reaches a release position and when all buttons their respective release positions the door handle can be turned to actuate the lock mechanism to open the door.

Figure 2:
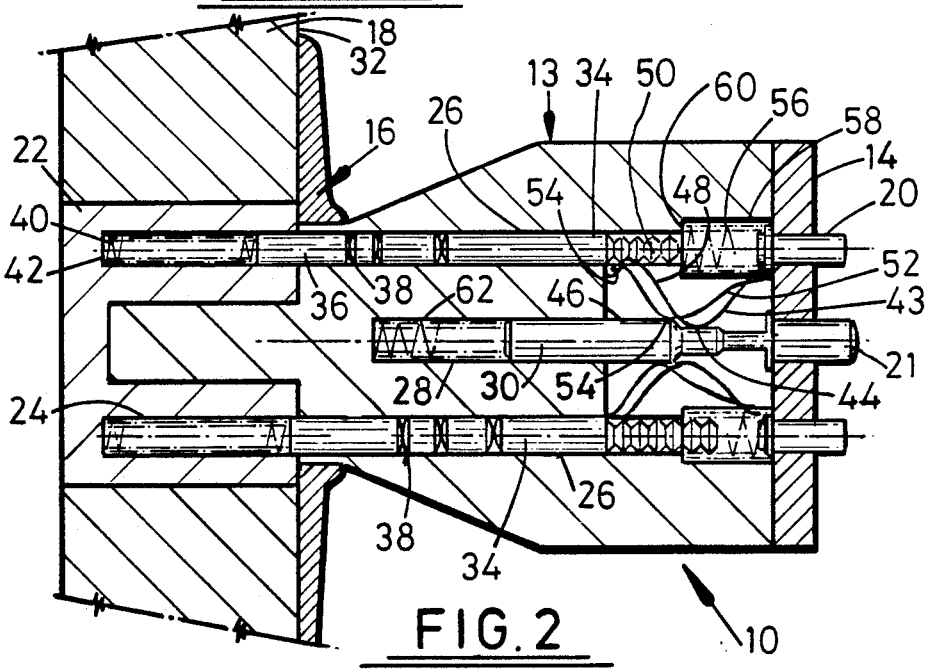
FIG. 2 is a transverse sectional view taken on the line 2—2 of FIG. 2 and depicting the keyless lock mechanism.

Reference is now made to FIG. 2 of the drawings which is an enlarged sectional view taken along the line 2—2 in FIG. 1. It will be seen that a mechanism 10 has a cylindrical portion 22 which is disposed in the door 18 for coupling to the locking mechanism 12. The handle 13 contains a plurality of cylindrical holes 26 which are aligned with respective buttons 20 for receiving part of a locking mechanism as will be described. The cylindrical holes 26 align with corresponding holes 24 in the cylindrical door cylinder. The handle 13 contains a central recess 28 which is adapted to receive the cam pin 30 which is coupled to lock button 21. Cover plate 16 is disposed at the base of the handle above the plane 32 of the door to secure the handle in place and to prevent interference with the handle.

In each recess 26 there is disposed a toothed rack 34 which engages with a back pin 36 position defined as a first split 38. A spring 40 is disposed in the recess 24 between a back face 42 and the pin 36. Only one push mechanism 20 will be described in detail and it will be appreciated that all the other mechanisms are substantially identical.

The spring 40 urges the pin 36 to push the toothed rack 34 into the recess 26 to adopt the position shown. In this position the pin 36 extends across the split plane 32 and as this is the same for each push button 20 the handle cannot be turned and the lock is in the locking position.

In order to release the pin 36 in the mechanism 20 the following procedure is adopted. The person knowing the desired number of pushes actuates push button 20. Push button 20 is coupled to a drive spring 43 which is bent as shown to sit on a shoulder 44 of a cam surface 46 of pin 28. The spring has a leading portion 48 which is proportioned to seat in a notch 50 defined by two adjacent teeth. A hold spring 52 is coupled to the interior of the face plate 16 and is also bent as shown to sit on a cam surface portion 54 which is of a greater diameter than portion 46. The hold spring has a leading portion 54 which seats in a notch in advance of notch 50.

The push button 20 is coupled to a button return spring 56 which lies in a recess 58 and the other end of the spring abuts against recess shoulder 60. In the example, the toothed rack has four teeth and the first split is adapted to coincide with the split plane after three presses of the push button 20 as will be described.

In operation, the operator knows that push button number two requires three pushes in order to advance the first split to coincide with the split plane 32. Thus when the operator pushes the button once the drive spring 43 pushes the toothed rack 34 against the spring 40 until the tooth is advanced over the leading edge 54 of the hold spring 52. When the push button is released the return spring 58 returns the push button to its original position, however, the hold spring 52 retains the toothed rack in the advanced position against the resilience of spring 40. Two successive pushes causes the first split 38 to coincide with the split plane 32. In this position, and if every other button is advanced so that the first split coincides with the split plane, the handle 13 can be turned to actuate the latch mechanism to open the door.

If the push button is pushed to few or to many times the first split does not coincide with the split plane and the handle cannot be turned. This is the situation for each push button mechanism.

Therefore it is essential to know how many times the push button must be actuated in order to advance the first split to the split plane. In this regard, the number of teeth pushes required to advance the first split to the split plane can be predetermined to vary the number of combinations for each button and for the device as a whole.

In order to lock the door again after all the first splits are coincided with the split plane 32 the operator depresses lock button 21. This causes the pin 30 to push against the return spring 62 so that the cam surfaces 46 and 44 are advanced out of contact with the curved portions of the respective drive and hold springs. When this occurs for each push button 20 the springs bias towards the central axis of the push button so that they disengage from the notches of the teeth and resilient return springs 40 force the rack back to its original or locked position. Release of the lock button 21 forces the drive and hold springs to return to their original positions engaging the respective notches in the teeth. When this occurs the pins 36 are forced across the split plane to lock the handle.

It will therefore be appreciated that the number of presses required to advance the first split of each mechanism 20 to coincide with the split plane is variable and this provides a considerable variation in the number of combinations available for each lock so that the chances of advertently opening the lock by random pressing of combinations is very small. Furthermore, if a push button 20 is pressed too few or too many times it does not reach a release position to permit the handle to be opened, therefore only the exact number of presses will suffice.

Various modifications may be made to the keyless lock mechanism hereinbefore described without departing from the scope of the invention. For example, as depicted in FIG. 2 the toothed rack 34 can have subsequent splits known as second and thrid splits. This is used to provide master and grand master keying of the lock for use in hotels and large suites of offices for example. In this case a different combination is used to advance each button so that a plurality of second splits coincides for a particular combination of presses on each button. When this occurs the lock can again be opened. The mechanism and locks can be designed so that this combination is the same for say one hundred lock on a floor of a hotel. Furthermore, a third split can be introduced to provide greater control over a larger number of locks. For example, if a code is entered via the push button so that the third splits coincide for each of a thousand locks then many floors of a large hotel or a large office building can incorporate a single lock coded in a different way thus minimising costs and ensuring control and security.

Although eight lock buttons are shown, any suitable number may be used consistent with costs and the requirement for security. For example, for safes and strong rooms ten or eleven buttons are used to provide substantially more combinations to increase security and minimise the probability of obtaining the correct combination. Although a single release button is shown, this could be replaced by two or more buttons depending on the design and requirements of the lock although for convenience in the example shown a single lock button is used. Also the lock button need not be spring biased and it can be turned to disengage the holding springs so that the return springs 40 return the mechanisms to their original positions. The toothed racks 34 are made of hardened steel and are rotatable within the recesses 26 to minimise the risk of being sawn through.

The springs can be disposed in any convenient arrangement although the arrangement as shown mounted in a single face is appropriate and facilitates assembly and use of the lock.

Figure 3:
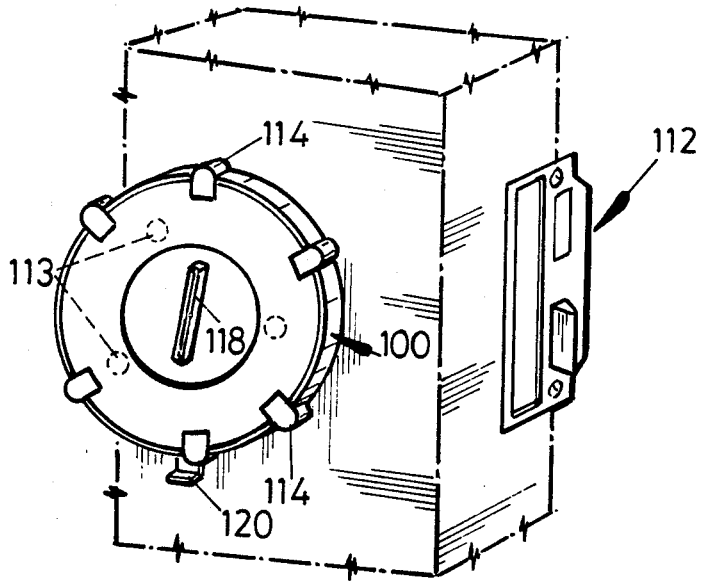
FIG. 3 is a perspective view of a case of an alternative keyless button lock in accordance with an alternative embodiment of the invention.

Reference is now made to FIG. 3 which depicts a keyless lock according to a second embodiment of the invention. The keyless lock has a disc-shaped housing 100 which replaces a conventional door handle and which is coupled to a door lock mechanism, generally shown by reference numeral 12. It will be appreciated that the casing may be fastened to the door by fixing screws 113 shown in broken outline which are disposed behind the housing and normally inaccessible. This disc-shaped housing 110 has six push buttons 114 disposed equiangularly around the periphery for entering a code to open the lock. Each button 114 is pressed a predetermined number of times, as before, until the operating mechanism, as will be later described in detail, advances a rack to a lock release position. When this is achieved for each button 114 the thumbit 118 can be rotated to actuate the door lock mechanism for opening the door.

The keyless lock mechanism can be reset using a reset lever 120 which can be pushed to one side to release each button simultaneously which will then return to its original state, as will be later described.

Figure 4:
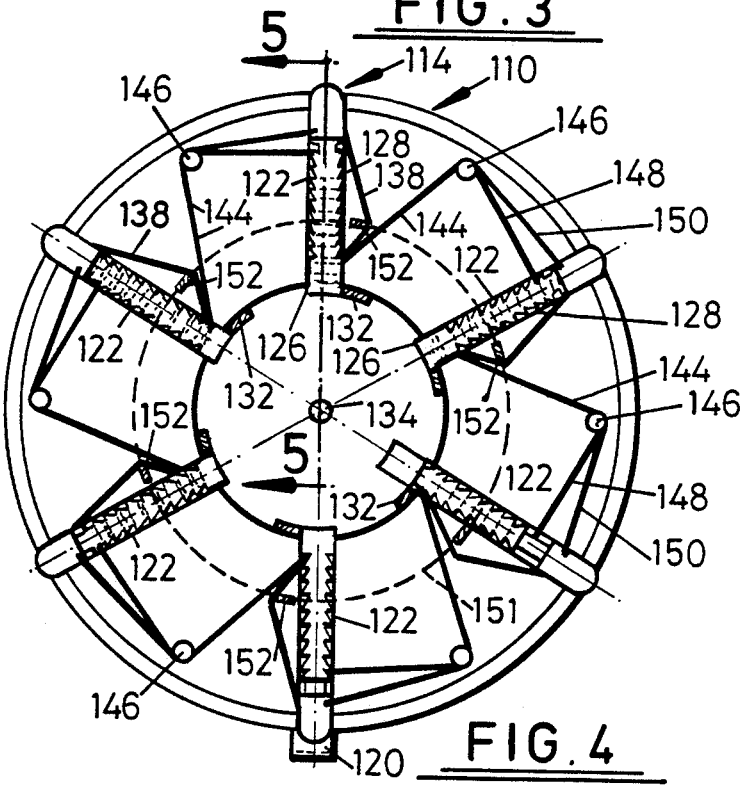
FIG. 4 is an enlarged view from the rear of the lock shown in FIG. 1 depicting part of the locking mechanism.
Figure 5:
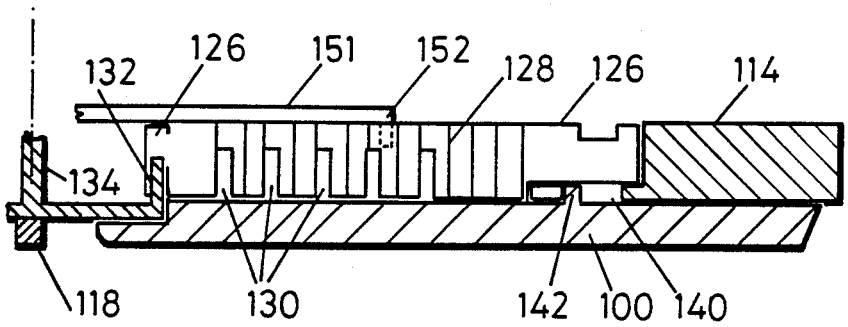
FIG. 5 is an enlarged sectional view taken on the line 5—5 of FIG. 4.

Reference is now made to FIGS. 4 and 5 of the drawings which depict in detail the operating mechanism for this embodiment of the keyless button lock. FIG. 4 shows a rear view of the locking mechanism shown in FIG. 3. The housing 100 defines six equiangularly spaced channels 122 each of which receive a button and rack generally indicated by reference numeral 124, and only one will be described in detail although it will be understood that the description applies to all buttons.

The button is disposed against a rack 126 which is of generally rectangular cross-section and which has a plurality of teeth 128 spaced along one or two sides thereof. Referring to FIG. 5, it will be seen that disposed in another side of the rack are a plurality of spaced gates 130 each adapted to receive a keep 132 for opening the lock as will be described. The keep is prevented from rotating by the end of the rack and in order for the lock to be opened each button must be depressed a set number of times to advance the rack towards the centre spindle 134 so that a gate 130 lies opposite keep 132. When each button has been depressed so that its respective rack is advanced to position, a desired gate opposite keep 132 this is the neutral position. The thumbit 118 to which keeps are attached can be rotated so that keeps 132 pass through the gates. The spindle 134 is coupled to the mechanism 112 for opening the door and rotating of the thumbit 118 and hence spindle 134 causes unlocking of the door.

The mechanism by which each rack 126 is advanced and reset will now be described in detail. The advance of the rack 126 is achieved by a drive spring 138 which is connected to button 114. The drive spring engages in a tooth 128 of the rack and button 114 has a recess 140, as shown in FIG. 5, which receives a peg 142 integral with housing 110. The recess 140 permits button 114 to advance the rack 126 one tooth at a time for precise control of position of gates 130 after a predetermined number of presses. The rack 126 is held in the advance position (as shown by the rack at 4 o'clock) by a hold spring 144 which is fastened around a peg 146 connected to housing 110. The other end of the hold spring is coupled to button and rack springs 148,150 which are connected to an adjacent button and rack respectively. This acts to anchor the hold spring and also urges both the button and rack towards the periphery.

Because the button 114 is free to move it is returned to its original position but the rack 126 stays in its advanced position because of the hold spring 144. Once each button has been depressed a set number of times so that desired gate 130 lies opposite the keeps the lock can be opened by rotating the thumbit as aforedescribed.

Reset of the racks from their advanced or neutral position to their original position is carried out by using a reset lever 120 which is coupled to a disc 150 (shown in broken outline in FIG. 4). The disc 150 has six pegs 152, one for each button rack, which depend from the disc, as best seen in FIG. 5 and normally lie between the channel 122 and the drive and hold springs 138,144. When the lever 120 is moved clockwise in FIG. 4 the pegs 152 push springs 138,144 clockwise out of contact with the teeth 128 of the respective racks. When this happens the button and rack springs 148,150 urge the button and rack towards the periphery of the housing to their original positions. This assumes that the keeps 132 are in the position shown in FIGS. 4, 5 and are not engaged in gates 130.

Master and grand master keying can be achieved using the same combination of presses to provide a different combination of gates to the neutral position through which the keeps can be rotated. However, the combination can be made the same for each lock as aforedescribed.

Figure 6:
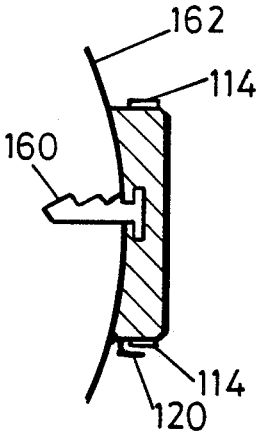
FIG. 6 shows an application of the structure shown in FIGS. 3–5 used as a keyless car door lock.

Reference is now made to FIG. 6 of the drawings which shows a lock in accordance with the second embodiment being used as a car door lock. The existing lock may have a cut key 160 disposed in the lock and covered by the locking mechanism and the mechanism fitted to a car door 162 in accordance with techniques for fitting such locks as will be appreciated by the man skilled in the art.

Operation of the new lock may be carried out as aforedescribed and the cut key secured to the thumbit will open the lock once the correct code has been entered in the conventional manner.

It will be understood that the number of buttons used, the number of teeth per button and the type of materials can be varied as required.

Advantages of the invention are that a considerable number of combinations can be provided by a lock to increase security thereof. The keyless lock can be combined with a lock mechanism to provide a compact and easy to install lock, and the lock permits master and grand master coding to permit it to be used in environments where such coding is required, for example, in hotels and office suites. The lock can also be configured to actuate an electromagnetic latch by for example, locating adjacent toothed rack so that when the first neutral position is reached the circuit is complete after each button is in a lock release position so that an electrical signal is sent to a solenoid, for example which opens an electromagnetic latch. A further advantage is that the mechanism has application in domestic security systems such as front door handles, hotels as well as in strong rooms and sages and the like. The second embodiment has further advantages of compactness and can be fitted over existing locks, and any number of turns can be permitted to actuate the locking mechanism.

I claim:

1. A keyless lock device comprising a housing having at least one lock release button disposed in a surface thereof and at least one lock element disposed on said surface, said lock release button being actuatable to define a plurality of lock positions and a plurality of lock release (position) positions and said lock element being operatively coupled to said lock release button, the arrangement being such that, in use, actuation of said lock release button a predetermined number of times attains one of said lock release positions whereby said keyless lock can be opened and actuation of said lock element actuates said lock release buttons to return to a locking position from said lock release position.

2. A keyless lock device as claimed in claim 1 wherein said plurality of lock release buttons are disposed in a circle on the face plate of said housing around said lock button.

3. A keyless lock device as claimed in claim 1 wherein said housing is disc-shaped and said buttons are disposed around the periphery of said disc on the curved surface thereof.

4. A keyless lock device as claimed in claim 1 wherein a locking mechanism is disposed in said housing and is coupled to said keyless button lock.

5. A keyless lock device as claimed in claim 1 wherein one of said lock release positions of each lock release button corresponds to a master code position.

6. A keyless lock device as claimed in claim 1 wherein at least three lock release positions are provided for each lock release button and two of said three lock release positions corresponding to a master and a grand master code position respectively.

7. A keyless lock device as claimed in claim 1 wherein the housing is mountable to a door and has a spindle coupled to a door locking mechanism and to actuation means to that turning the actuation means opens the locking mechanism.

8. A keyless lock device as claimed in claim 7 wherein the actuation means is a handle.

9. A keyless lock device as claimed in claim 7 wherein the actuation means is thumbit.

10. A keyless lock device as claimed in claim 8 wherein the handle has a plurality of recesses each in register with a corresponding recess in a door cylinder and the door surface defines a split plane about which the handle can be turned to open, each recess having a pin disposed therein being resiliently biased to push the pin to extend said split plane partly into the registering recess on said handle, each button having an associated advance mechanism by which depressing the corresponding release button forces said pin back to said split plane when said buttin is depressed a predetermined number of times to define said release position.

11. A keyless lock device as claimed in claim 10 wherein each keyless button mechanism and said release button is coupled to a toothed rack, the rack being proportioned so that when said button is pushed a predetermined number of times the first split is on one of the split planes, so that when each split plane of all the buttons coincide said handle can be turned to open the lock.

12. A keyless lock device as claimed in claim 11 wherein all key lock buttons are coupled to a single lock button which is resiliently biased and depression of said single lock button releases all buttons from release said position to return to said lock position.

13. A keyless lock device as claimed in any of claim 12 wherein said advance mechanism includes a drive spring coupled between its respective button and the toothed rack, and the lock spring coupled to the face plate and engaged with a tooth of said toothed rack, said springs being supported on a cam surface of said lock pin in the locking position.

14. A keyless lock device as claimed in any one of claim 13 wherein each button is coupled to a return spring disposed in a recess and after depression of each button and advancement of said toothed rack said return spring returns said button to its original position.

15. A keyless lock device as claimed in claim 9 wherein each button is coupled to a toothed rack of generally rectangular cross-section having a plurality of gates disposed therealong, said thumbit being rotatable and being coupled to a keep adapted to pass through said gates, the arrangement being such that in response to a predetermined number of presses, an advance mechanism advances each rack until each rack has a gate at the neutral position, said thumbit is rotatable so that the keep passes through the gates permitting the locking mechanism to be opened.

16. A keyless lock device as claimed in claim 15 wherein each advance mechanism includes a drive spring coupled to each button and engaged with a tooth of said rack, and a hold spring for holding said toothed rack in an advanced position.

17. A keyless lock device as claimed in claim 16 including reset means for resetting each rack and button to its original position, said reset means including a lever extending beyond the periphery of said housing and having a plurality of pegs normally disposed between said rack and said hold and rive springs, and resilient means for urging said rack and button to their original positions, whereby, in use, actuation of the lever to move said drive and hold springs out of engagement with said toothed rack permits said resilient return means to urge all racks and buttons to their original positions.

18. A keyless lock device as claimed in claim 17 wherein said hold spring for one button is anchored to the rack and button of a next adjacent button.

19. A keyless lock device as in claim 2 in combination with a car door lock, said device including a car key disposed in said car door lock and coupled to a lock actuating means disposed in said housing for opening said car door lock once the correct combination has been entered by said lock release buttons.

* * * * *